United States Patent [19]

Grube

[11] 4,352,328

[45] Oct. 5, 1982

[54] COUPLING ASSEMBLY FOR OVERHEAD RAIL MATERIALS-TRANSPORT SYSTEM

[75] Inventor: Erwin Grube, Bielefeld, Fed. Rep. of Germany

[73] Assignee: Dürkoppwerke GmbH, Bielefeld, Fed. Rep. of Germany

[21] Appl. No.: 158,126

[22] Filed: Jun. 10, 1980

[30] Foreign Application Priority Data

Jun. 13, 1979 [DE] Fed. Rep. of Germany ..... 2923890

[51] Int. Cl.[3] ..... B65G 17/12; B61B 10/02

[52] U.S. Cl. ..... 104/172 S

[58] Field of Search ..... 104/89, 252, 172 S, 104/110, 106, 107

[56] References Cited

U.S. PATENT DOCUMENTS 3,523,504 8/1970 Jones ..... 104/172 S 4,287,829 9/1981 Wakabayashi ..... 104/172 S

FOREIGN PATENT DOCUMENTS 2650031 12/1978 Fed. Rep. of Germany .

*Primary Examiner*—Richard A. Bertsch

*Attorney, Agent, or Firm*—Karl F. Ross

[57] ABSTRACT

In an overhead-rail materials-conveyance system including an endless drive chain juxtaposed to an endless rail for driving hanger-type carriers suspended therefrom by means of wheels, a coupling assembly for carrier entrainment comprises a plurality of jaws pivotably mounted on the drive chain for swinging about respective axes parallel to the transport direction. The jaws are each provided with beveled edges for cammingly engaging coupling and uncoupling heads projecting vertically from front and back ends, respectively, of the carriers; the jaws have recesses of a breadth greater than the width of the coupling heads and less than the width of the uncoupling heads for forming locked engagements with only the coupling heads upon spreading of the jaws thereby. Upon the approach of a train of carriers towards a standing carrier, the uncoupling head thereof spreads the jaws entraining the first carrier in the train, thereby releasing this carrier. The uncoupling jaws then pass through the spread jaws which are subsequently opened by and locked to the coupling head of the standing carrier, whereby the same becomes entrained as a new first carrier.

6 Claims, 7 Drawing Figures

9
10
10'
10''
11
11'
11''
12
12 (13)
13
19
20
27
28
T
R
F
t
$w_1$
$w_2$
$b_1$
$b_2$

COUPLING ASSEMBLY FOR OVERHEAD RAIL MATERIALS-TRANSPORT SYSTEM

FIELD OF THE INVENTION

My present invention relates to materials-handling systems of the overhead-rail type in which a multiplicity of goods carriers are movably suspended from one or more endless tracks. More particularly, my present invention relates to a coupling assembly in such a system for temporarily entraining the carriers to a drive.

BACKGROUND OF THE INVENTION

An assembly for coupling and uncoupling carriers from a drive in an overhead-rail materials-conveyance system is described in German patent 2,650,031. In this assembly a coupling lever is connected to a pivotably mounted uncoupling lever via an angled or elbow lever. The coupling and uncoupling levers project into the path of coupling and uncoupling heads extending vertically upwards from the carriers. The entraining assembly comprises in total four movably mounted interconnected levers with a similar number of linking pins; these pins extend perpendicularly to the transport direction and are set in motion upon operation of the entraining or coupling assembly. Wear of the pins leads to disturbances in service, in particular to undesired release of goods upon a swinging or vibration thereof, such swinging occurring at changes in transport direction such as from horizontal to inclined. A further disadvantage of known coupling assemblies is the noise caused by the many moving elements.

OBJECTS OF THE INVENTION

An object of my present invention is to provide an improved coupling assembly of the above-mentioned type, which has few moving parts and thus less tendency to wear and greater reliability.

Another object of my present invention is to provide such a coupling assembly which has a reduced average noise level.

SUMMARY OF THE INVENTION

A materials-handling or -conveyance system according to my present invention comprises a multiplicity of carriers, an endless track or rail for supporting the carriers, a drive for moving the carriers along the track and a plurality of spaced grippers on the drive for at least temporarily securing at least some of the carriers thereto to form a train of carriers for the transport of goods. A coupler is provided on each carrier for engaging and forming a lock with any of the grippers to connect the respective carrier to the drive, while actuators on each of the carriers engages, upon the approach of a train of carriers towards a standing or stationary carrier, the gripper locked thereto to release the lock, thereby enabling the stationary carrier to become entrained by the released gripper.

According to a feature of my present invention, the grippers each include a pair of jaws hingedly secured to the drive for pivoting at least under the influence of gravity about respective axes parallel to the track. The actuators function as separators for spreading the jaws in a direction substantially perpendicular to the direction of carrier transport.

According to further features of my present invention, the couplers and uncouplers respectively comprise first and second substantially vertical projections on the carriers and each pair of jaws is provided on a front side, i.e. on a side facing the direction of carrier motion, with camming means including beveled edges for coacting with the first vertical projections to spread the respective pair of jaws prior to the formation of a carrier-entraining lock and for coacting with the second vertical projections to spread the respective pair of jaws to uncouple the same from a first vertical projection locked thereto. Each pair of jaws includes a recess having a breadth measured parallel to the track or rail, the first projections having a common width parallel to the track less than the recess breadth and the second projections having a width parallel to the track greater than the recess breadth, whereby the first and second projections are respectively lockable and not lockable to the jaws.

According to a more particular feature of my present invention, each pair of jaws comprises a pair of L-shaped jaw members having inwardly extending generally horizontal plates on which the beveled edges are formed. Each of the plates includes a recess spaced from a respective beveled edge.

According to an alternative feature of my present invention, each pair of jaws comprises a pair of generally vertical jaw plates each having an inwardly turned edge, i.e. turned toward the other plate, inclined with respect to the horizontal to form a respective beveled edge; each plate has a recess spaced from the respective beveled edge.

BRIEF DESCRIPTION OF THE DRAWING

These and other features of my present invention will now be described in detail, reference being made to the accompanying drawing in which.

SPECIFIC DESCRIPTION

Figure 1:
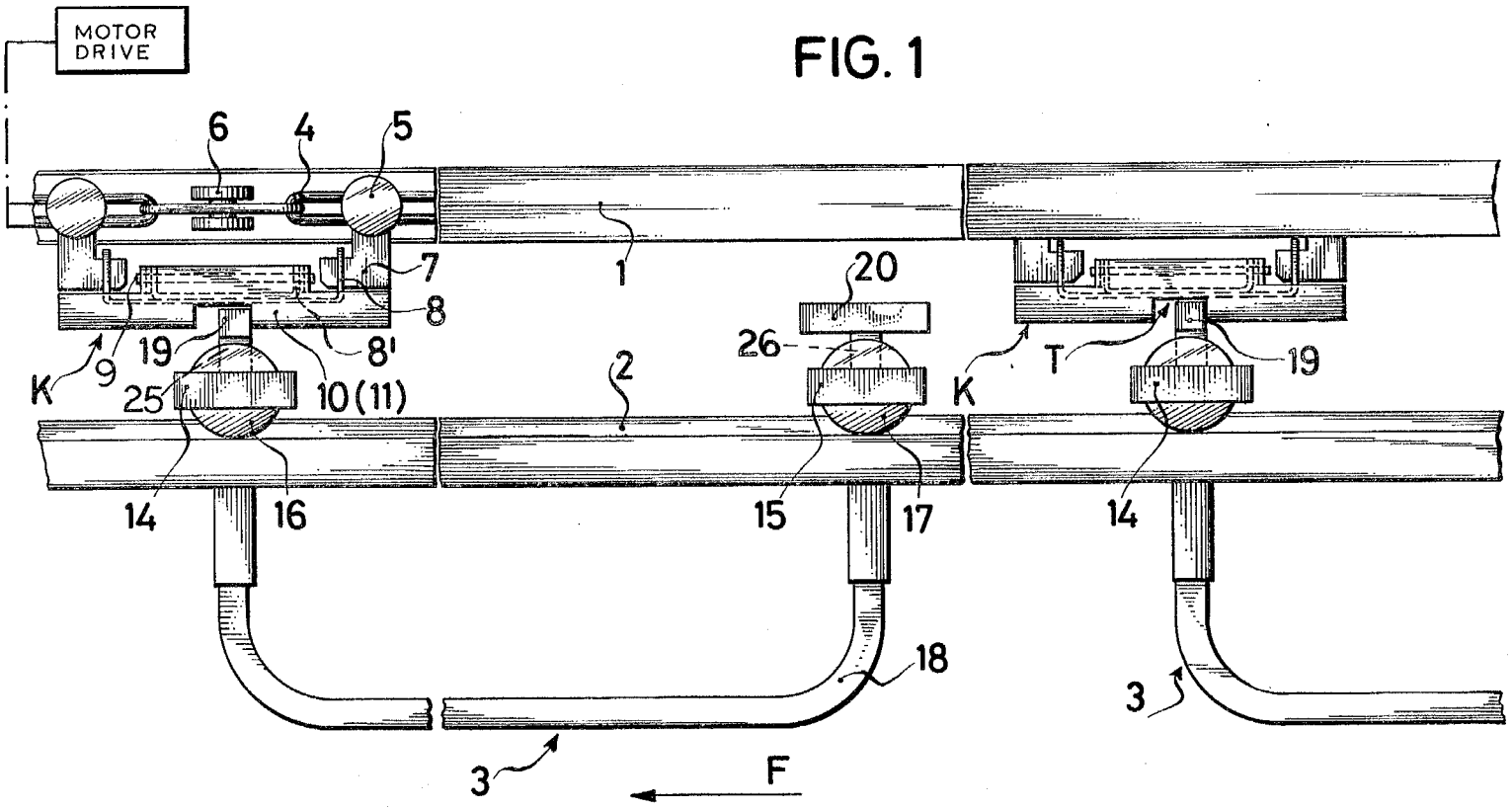
FIG. 1 is a partial side view of an endless track and endless chain drive in an overhead-rail materials-transport system, showing a pair of hanger-type carriers and coupling jaws according to my present invention.
Figures 2A, 2B, 2C:
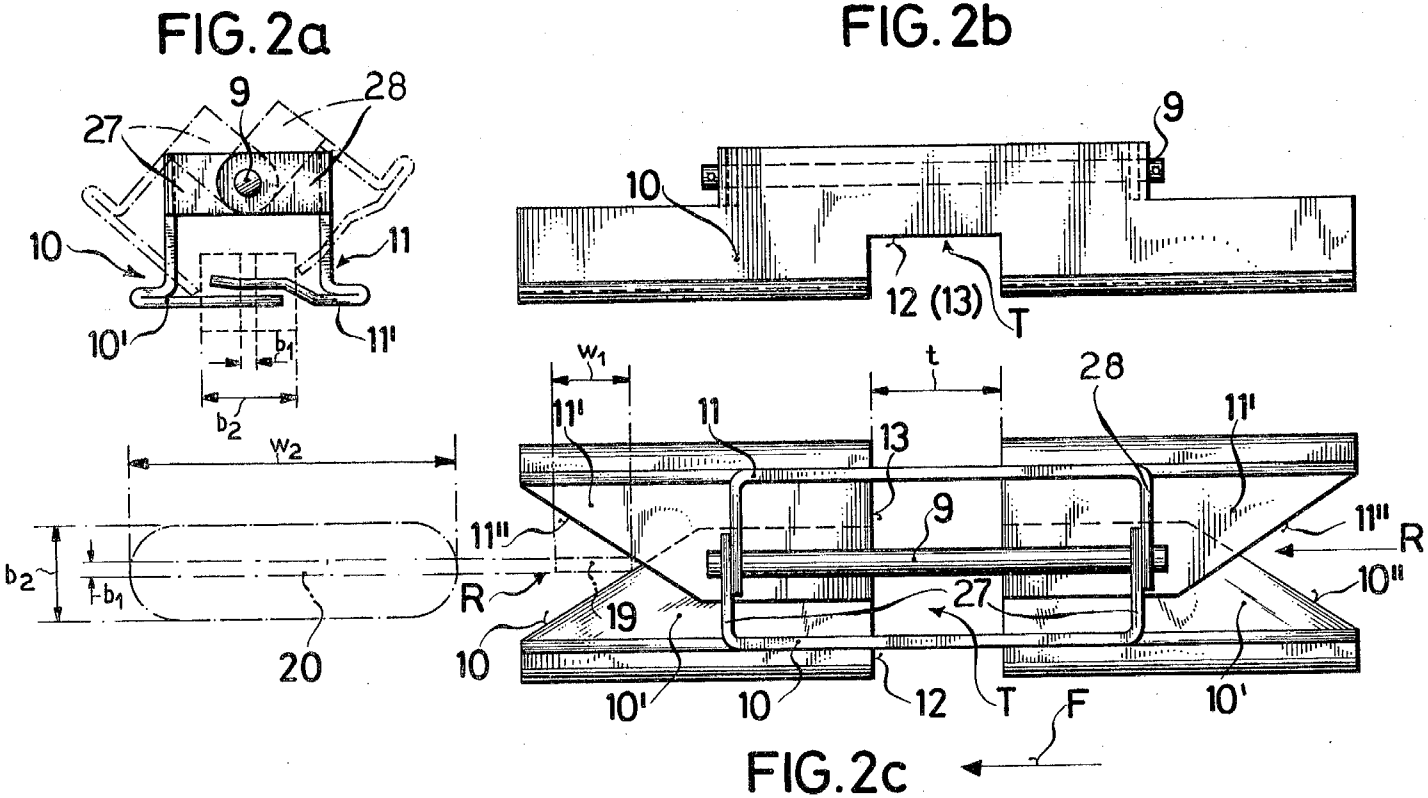
FIG. 2*a* is a front view of a pair of coupling or gripper jaws shown in FIG. 1.
FIG. 2*b* is a side view of the gripper jaws shown in FIGS. 1 and 2*a;*
FIG. 2*c* is a top view of the jaws shown in FIGS. 1, 2*a*, 2*b;*
Figure 3B:
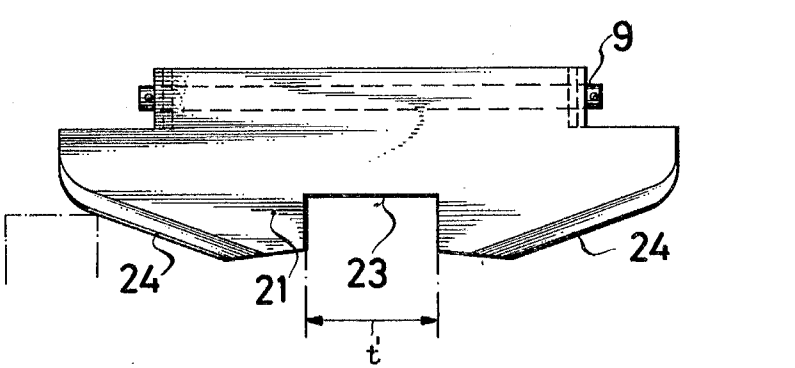
FIG. 3*b* is a side view of the jaws shown in FIG. 3*a;*.
Figure 3A:
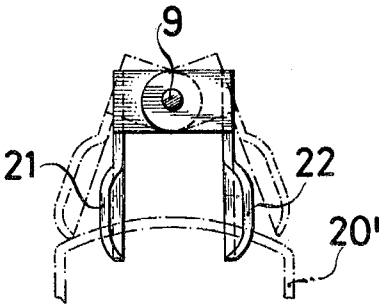
FIG. 3*a* is a front view similar to FIG. 2*a*, of an alternative embodiment of the jaws shown in FIGS. 2*a*–2*c;*
Figure 3C:
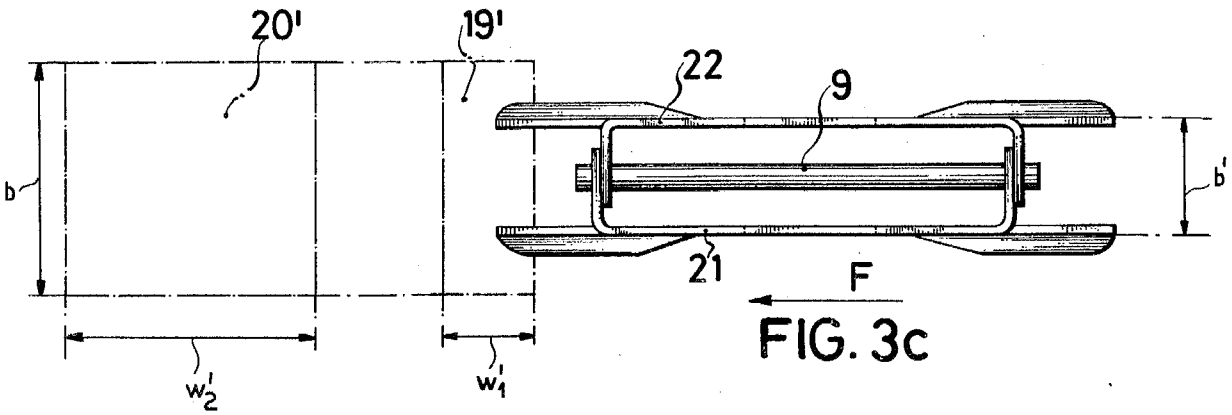
FIG. 3*c* is a top view of the jaws shown in FIGS. 3*a* and 3*b*.

As shown in FIG. 1, a materials-handling apparatus or system for transporting articles of clothing, for example, generally includes a rail 2 suspended above the ground by a support structure (not shown) and formed as a portion of rail network having loading stations where materials are conveyed to the system and unloading stations where such materials are removed from the system. Frequently rail 2 is an endless track having a loading and unloading station at a common point. Suspended above rail 2 is a channel 1 housing an endless drive chain 4 provided with a set of vertical rollers 5 bearing on channel 1 for supporting chain 4 and a set of horizontal rollers 6 serving to guide chain 4 within the channel 1.

Certain pairs of consecutive vertical rollers 5 carry respective pairs of inwardly turned L-shaped brackets or angles 7 on which are mounted a U-shaped bracket or stirrup 8 in turn supporting another U-shaped member 8'. On an axle or pin 9 journaled in the vertical shanks of member 8' is pivotably mounted a pair of jaw members 10, 11 which swing at least partially under the influence of gravity about a horizontal axis defined by pin 9 and extending parallel to rail 2.

As illustrated in FIG. 1, a multiplicity of carriers 3 each comprising a U-shaped tubular hanger 18 rigid at one end with a forward wheel holder 14 and at an opposite end with a rear wheel holder 15 are shiftably suspended on rail 2 by means of wheels 16 and 17 rotatably mounted in holders 14 and 18, respectively. A coupling head or lug 19 is attached to each carrier 3 at the forward wheel holder 14 thereof, while an uncoupling or releasing head 20 is connected to the associated rear wheel holder 15. Heads 19 and 20 form cross-piece extensions to a pair of vertical projections 25 and 26 rigid with holders 14 and 15.

Each pair of jaws 10, 11 includes a pocket T for forming a locked engagement with the coupling head 19 of a respective carrier 3 whereby this carrier is connected to the continuously operating drive chain 4. Each pair of jaws is provided on a forward side, relative to the direction F of carrier motion and goods conveyance, with camming means R for coacting with a coupling head 19 to spread the jaws prior to the locking engagement of the respective jaws pocket T with such head and for coacting with an uncoupling head 20 to spread the jaws to release a coupling head 19 locked thereto, as described in detail hereinafter with respect to the operation of a coupling assembly according to my present invention.

As illustrated in FIGS. *2a–2c*, jaw members 10, 11 are formed as L-shaped plates having respective inwardly turned generally horizontal flanges or plate portions 10', 11' which are provided at least on a forward or front side with respective beveled edges 10'', 11''. These beveled edges comprise camming means R. Pocket T takes the form of a pair of L-shaped recesses 12 and 13 disposed substantially in the middle of jaw members 10 and 11. As best seen in FIG. *2a*, jaws 10,11 are secured to axle 9 by means of two flanges or braces 27, 28 connected at right angles to generally vertical shanks of the L-shaped jaw members. As shown in FIG. *2b* recesses 12, 13 extend only part way up these vertical shanks. Preferably, jaw members 10, 11 have beveled edges 10'', 11'' on both sides (see FIG. *2c*) to facilitate changes in transport direction.

Coupling heads 19 have a common length $w_1$, measured parallel to rail 2, less than the breadth or width t of recesses 12, 13, while uncoupling heads 20 have a common length $w_2$ greater than width t, whereby these heads are prevented from entering pockets T. It is advantageous for the uncoupling heads 20 to have a width or breadth $b_2$ (see FIG. *2a*), measured perpendicularly to transport direction F, greater than a corresponding dimension $b_1$ of the coupling heads 19.

As indicated in FIG. 1, in a train of carriers or trolleys 3 the coupling lugs 19 of consecutive carriers 3 are locked in recesses or pockets T of consecutive jaws 10, 11. Upon the approach of such a carrier train toward a standing or stationary trolley, the forward camming edges 10'', 11'' of the jaws 10, 11 locked to the coupling head of the first carrier in the train engage the uncoupling head 20 of the stationary trolley. This uncoupling head spreads the lead pair of jaws, whereupon the coupling head 19 of the first carrier slips out of the pocket T of these jaws. The uncoupling head of the standing carrier passes between the separated jaws which then pivot, under the influence of gravity, about the respective axle 9 to enter a closed state. The lead jaws remain in this closed state until their forward camming edges 10'', 11'' engage the coupling head of the standing carrier, whereupon the jaws open and subsequently come together, locking this coupling head in pocket T and thus entraining the standing carrier. In a similar process the previously first carrier becomes entrained by the previously second jaws or gripper.

A carrier 3 is removed from a train by means of auxiliary equipment (or even via manual controls) exerting a transverse force on the carrier at its forward wheel holder 14 or at its coupling lug 19, whereby the respective forward wheel 16 is pushed from rail 2 onto a secondary or branching track (not shown).

In another embodiment of my present invention, shown in FIGS. *3a–3c*, a pair of jaws comprises a pair of generally vertical plates 21, 22 pivotably secured to axle 9 and provided with inturned edges 24 beveled at an angle with respect to the horizontal. Edges 24 cammingly interact with arched or convex upper plates of a coupling head 19' and an uncoupling head 20' to spread jaw members 21, 22. Heads 19', 20' form substantially horizontal extensions of respective vertical projections secured to carriers 3 (see FIG. 1). Jaw members 21, 22 are provided with centrally disposed rectangular recesses 23 having a breadth t', measured parallel to rail 2 greater than the width $w_1'$ of head 19' and less than the width $w_2'$ of head 20', whereby head 19' is able to slip into recess 23 to lock the respective carrier 3 to chain drive 4 and whereby head 20' is prevented from slipping into recess 23. It is also a requisite in the embodiment of FIGS. *3a–3c* that heads 19', 20' have a breadth b, not necessarily the same, greater than the distance b' between plates 21 and 22.

A coupling assembly according to my present invention presents structural as well as functional advantages. Such an assembly comprises only a few parts which are relatively easy to attach to one another and which once assembled, must undertake movements only about a longitudinal axis. No springs and no latching levers are necessary, ensuring a high reliability. By means of guides connectable to the channel 1, it is possible to obtain absolute security against undesired uncouplings in particularly long stretches of track, which security is not possible with conventional coupling systems having longitudinally movable parts, i.e. movable in the transport direction.

I claim:

1. A materials-handling system comprising:

a multiplicity of carriers;

track means including at least one endless rail for supporting said carriers upon motion thereof along said rail;

drive means juxtaposed to said track means for driving said carriers along said rail;

entraining means including a plurality of spaced grippers on said drive means for at least temporarily securing at least some of said carriers thereto to form a train of carriers for the transport of goods;

coupling means on each of said carriers for engaging and forming locks with said grippers to connect the respective carriers to said drive means; and uncoupling means including actuators on each of said carriers for engaging, upon the approach of a train of carriers toward a stationary carrier, said entraining means to release the lock formed between a gripper and the coupling means of a first carrier in such approaching train, whereby said stationary carrier may become entrained via the released gripper, said grippers each including a pair of juxtaposed elongated jaws extending in the direction of movement of said drive means and hingedly secured to said drive means for pivoting at least partially under the influence of gravity, about respective axes parallel to said actuators including separating means for spreading said jaws simultaneoulsy in opposite senses transverse to said direction, said jaws confronting one another transversely of said direction.

2. The system defined in claim 1 wherein said coupling means and said separating means respectively include first substantially vertical projections and second substantially vertical projections on said carriers and each pair of said jaws is provided on a forward side with camming means including beveled edges for coacting with said first vertical projections to spread the respective pair of jaws prior to the formation of a carrier-entraining lock and for coacting with said second vertical projections to spread the respective pair of jaws to uncouple the same from a first vertical projection locked thereto.

3. The system defined in claim 2 wherein each pair of said jaws includes a recess having a breadth measured parallel to said rail, said first vertical projections having a common width parallel to said rail less than said breadth and said second vertical projections having a width parallel to said rail greater than said breadth, whereby said first vertical projections and said second vertical projections are respectively lockable and unlockable to said jaws.

4. The system defined in claim 3 wherein each pair of jaws comprises a pair of L-shaped jaw members having inwardly extending generally horizontal plates, said beveled edges being formed on said horizontal plates, each of said plates including a recess spaced from the respective beveled edge.

5. The system defined in claim 3 wherein each pair of jaws comprises a pair of generally vertical jaw plates each having an inwardly turned edge inclined with respect to the horizontal to form a respective beveled edge, each plate having a recess spaced from the respective beveled edge.

6. In a materials-handling system including an endless rail forming a track for the transport of goods, a plurality of goods carriers of a common length movably mounted on said rail for motion in a transport direction along said track and drive means juxtaposed to said rail for driving said carriers, an assembly for linking said carriers to said drive means, comprising:

a plurality of coupling heads attached at front ends of respective carriers, said heads having a substantially common width parallel to said track;

a plurality of uncoupling heads attached to rear ends of respective carriers, said uncoupling heads having a substantially common width parallel to said track greater than the width of said coupling heads; and a plurality of pairs of jaws pivotably mounted on said drive means for swinging about respective axes parallel to said track, said pairs of jaws each being provided with camming means including a pair of beveled edges for coacting with said coupling heads and with said uncoupling heads to spread the respective jaws, said pairs of jaws each being further provided with recesses of a breadth, measured parallel to said transport direction, greater than the width of said coupling heads and less than the width of said uncoupling heads, the jaws of each pair confronting one another and being elongated in said direction.

* * * * *